US005248022A

United States Patent [19]

Kamikawa et al.

[11] Patent Number: 5,248,022

[45] Date of Patent: Sep. 28, 1993

[54] DRIVING DEVICE HAVING SEALING MECHANISM

[75] Inventors: Yuji Kamikawa, Uto; Mitsuo Nishi, Kumamoto, both of Japan

[73] Assignees: Tokyo Electron Limited, Tokyo; Tokyo Electron Kyushu Limited, Kumamoto; Tokyo Electron Saga Limited, Tosu, all of Japan

[21] Appl. No.: 935,460

[22] Filed: Aug. 26, 1992

Related U.S. Application Data

[63] Continuation-in-part of Ser. No. 795,807, Nov. 21, 1991, abandoned.

[30] Foreign Application Priority Data

Nov. 28, 1990 [JP] Japan ..... 2-331313
Aug. 26, 1991 [JP] Japan ..... 3-236815

[51] Int. Cl.[5] ..... B66B 11/04
[52] U.S. Cl. ..... 187/17; 187/29.2
[58] Field of Search ..... 187/17, 28, 29.2, 110, 187/38, 9 F; 91/168, 169, 390, 189 R; 254/59 R

[56] References Cited

U.S. PATENT DOCUMENTS 3,715,014 2/1973 Ohta ..... 187/17
4,043,428 8/1977 White et al. ..... 187/17

*Primary Examiner*—Robert P. Olszewski
*Assistant Examiner*—Kenneth Noland
*Attorney, Agent, or Firm*—Oblon, Spivak, McClelland, Maier & Neustadt

[57] ABSTRACT

A driving device comprises a first cover, a second cover telescopically engaging with the first cover, and a third cover surrounding the first and second covers. Part of a driving member for moving the second cover in relation to the first cover is arranged in a first space defined in the first cover. The first space is supplied with nitrogen, and pressure in the space is kept at a positive value. Gas is fed into and exhausted from a second space defined between the first and second covers, in accordance with a change in the volume thereof, whereby pressure in the second space is kept at a substantially constant value. Gas contained in a third space defined between the third cover and the first and second covers is exhausted, and pressure in the third space is kept at a negative value. Thus, the first space is completely isolated from a space around the driving device.

16 Claims, 9 Drawing Sheets

DRIVING DEVICE HAVING SEALING MECHANISM

This application is a continuation-in-part of application Ser. No. 07/795,807, filed on Nov. 21, 1991, now abandoned.

BACKGROUND OF THE INVENTION

1. Field of the Invention

This invention relates to a driving device having a sealing mechanism, and more particularly, to a device of this type suitable for applying to an apparatus which should be used in a condition without dust and performs a chemical treatment or the like.

2. Description of the Related Art

A washing apparatus for use in a semiconductor wafer manufacturing system is exemplified as an apparatus which should be used in a condition place without dust and performs a chemical treatment.

In the wafer manufacturing system, wafers are subjected to washing in a clean atmosphere without dust so as not to be adversely affected by dust, and are continuously subjected to ammonia treatment, water rinse treatment, hydrofluoric acid treatment, etc.

Conventional washing devices each have a plurality of treatment vessels provided for performing the above treatments, respectively. Wafers are transferred to the vessels by means of a boat or other transfer unit driven by a driving device.

This driving device may cause dust during operation thereof, thereby contaminating a clean atmosphere in which semiconductor wafers are processed. More specifically, the dust may adhere to wafers which are being subjected to fine processing, reducing the yielding percentage of wafer products.

Further, since the driving device is coupled with the movable portion of the above-described transfer unit, it cannot be completely sealed. Thus, ammonia used in the washing device may leak into the driving device, thereby corroding the same.

SUMMARY OF THE INVENTION

It is the object of the invention to provide a sealing mechanism for a driving device, which allows a slight clearance between the driving device and the outside, prevents dust from leaking from the driving device, and also prevents the atmosphere of the outside from flowing into the interior of the driving device and corroding the same.

According to a first aspect of the invention, the driving device comprises:

a first cover defining a first space therein;

a second cover having an open end, and telescopically engaging with the first cover through the open end, for defining a second space therebetween;

driving means for moving the second cover in relation to the first cover in the axial direction thereof, part of the driving means at least being arranged in the first space;

a third cover arranged to surround the first and second covers over a range in which the open end of the second cover moves, the third cover defining a third space between itself and the first and second covers;

gas supply means for maintaining pressure in the first space at a positive value;

pressure controlling means for supplying and exhausting a gas into and from the second space in accordance with a change in the volume thereof caused by movement of the second cover in relation to the first cover, thereby maintaining pressure in the second space at a substantially constant value; and exhaustion means for maintaining pressure in the third space at a negative value.

According to a second aspect of the invention, the driving device comprises:

a first cover defining a first space therein;

a second cover having an open end, and arranged coaxial with the first cover and surrounding the same, for defining a second space therebetween;

driving means for moving the second cover in relation to the first cover, part of the driving means at least being arranged in the first space;

a third cover arranged to surround the first and second covers over a range in which the open end of the second cover moves, the third cover defining a third space between itself and the first and second covers;

gas supply means for maintaining pressure in the first space at a positive value; and exhaustion means for maintaining pressure in the third space at a negative value.

In the driving device constructed as above, pressure in the first cover is kept at a positive value by means of the pressurizing means, and pressure in the space between the third cover and the first and second covers is kept at a negative value by exhausting gas therein by use of the exhaustion means. Therefore, gas existing inside the first cover always flows out of the same by the effect of the pressure difference. For example, dust caused in the first cover flows into the space between the first and second covers is forcibly exhausted therefrom.

On the other hand, air which flows from the outside into the space between the third cover and the first and second covers is sucked by the exhaustion means, together with the gas leaking from the first cover.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

A driving device according to the invention will be explained in detail with reference to the accompanying drawings showing an embodiment in which the driving device is applied to a washing apparatus employed in a semiconductor wafer manufacturing system.

Figure 1:
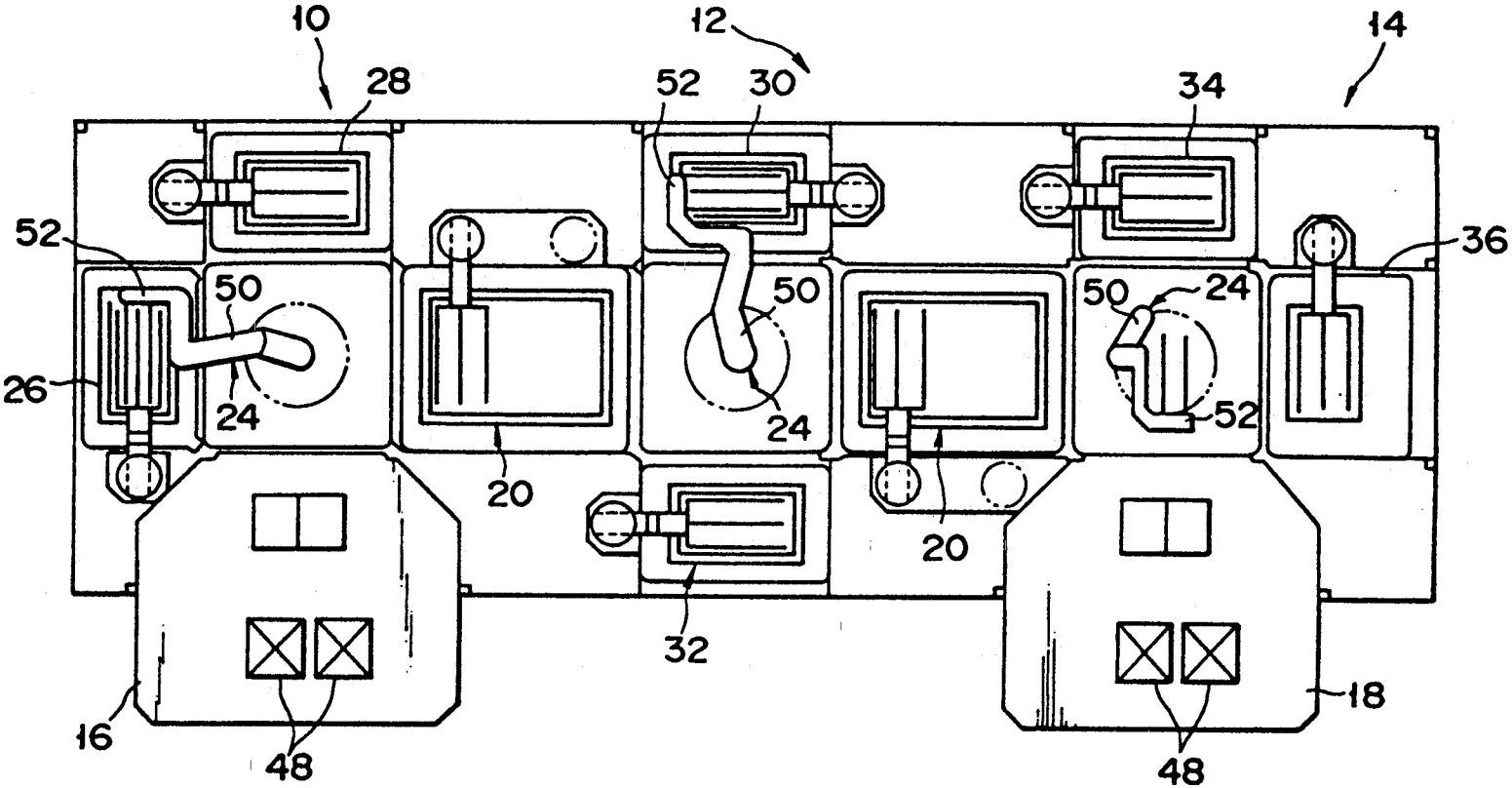
FIG. 1 is a plan view showing the entire arrangement of a washing apparatus according to the invention.

As is shown in FIG. 1, the washing apparatus of the embodiment comprises three washing units 10, 12, and 14. The unit 10 arranged on the wafer carry-in side is connected to a loader 16 for loading wafers to be processed. The unit 14 arranged on the wafer carry-out side is connected to an unloader 18 for unloading wafers having been processed. Underwater loaders 20 are provided between the units 10 and 12 and between the units 12 and 14. This arrangement may be changed. In this embodiment, the arrangement is determined to accord to a predetermined washing program.

The washing unit 10 has a rotary transfer arm 24 arranged in the center thereof for transferring a semiconductor wafer 22, and washing vessels 26 and 28 arranged on the left side of the arm 24 and in front of the loader 16, respectively. In the embodiment, the vessel 26 is used as a chemical processing vessel for performing ammonia treatment, while the vessel 28 is used as a quick damp rinse (QDR) vessel for performing water rinse treatment.

In the central washing unit 12, the underwater loaders 20 are arranged on the both opposite sides of the rotary transfer arm 24 located in the center of the central washing unit 12, and washing vessels 30 and 32 are arranged in front of the arm 24 and in rear of the same, respectively. The vessel 30 is used as a chemical vessel for performing hydrofluoric acid treatment, while the vessel 32 is used as water overflow treatment vessel.

The washing unit 14 has a rotary transfer arm 24 arranged in the center thereof, and a washing vessel 34 and a drying vessel 36 arranged on the right side of the arm 24 and in front of the loader 18, respectively. In the embodiment, the vessel 34 is used as final water rinse treatment vessel.

Figure 4:
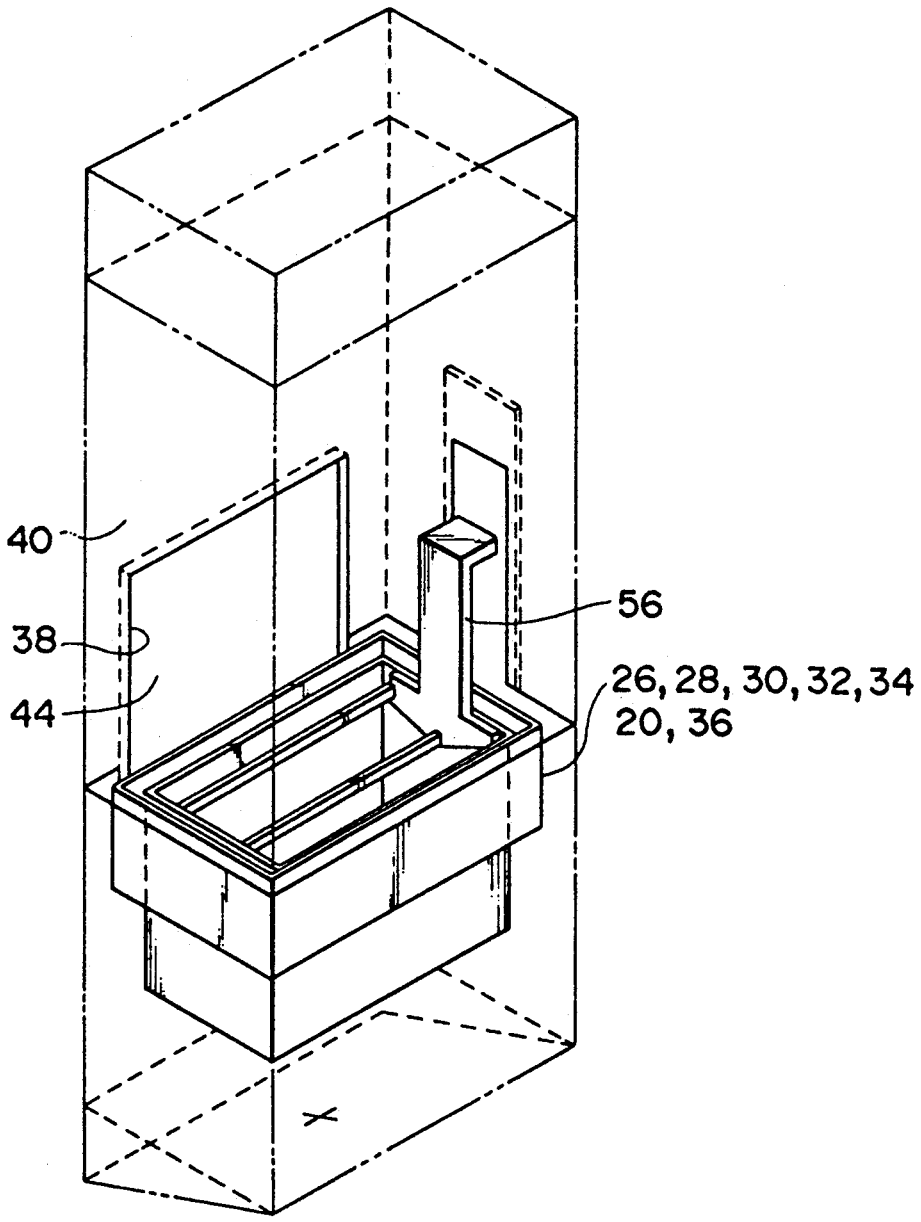
FIG. 4 is a sectional view showing washing vessels, an underwater loader, and a drying vessel.

As is shown in FIG. 4, each of the vessels 26, 28, 30, 32, and 34, underwater loaders 20, and drying vessel 36 is received in a case 40 having an opening 38 for carrying in and out the semiconductor wafer 22 (in the case of the underwater loaders 20, opening 38 are formed in the both opposite sides of each border). A shutter 44 is provided for opening and closing the opening 38. An air blow port (not shown) is provided in that portion of the case 40 which is located upward of the shutter 44. The atmosphere in the case 40 is shut out from the outside by means of the shutter 44 and an air curtain supplied through the air blow port. In this case, air is exhausted from the lower portion of the case 40 so that pressure therein is controlled to a value slightly lower than the outside atmospheric pressure, thereby preventing the atmosphere therein from leaking to the outside.

Figure 2:
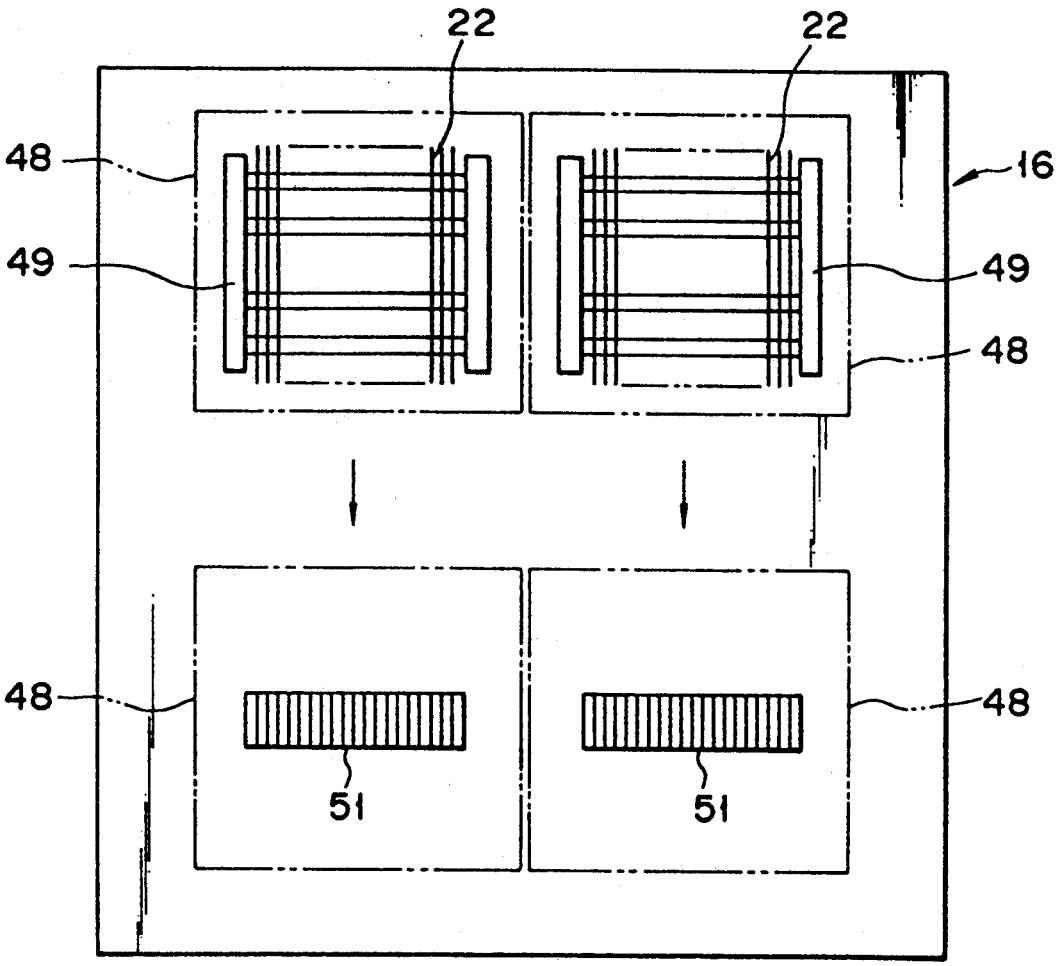
FIG. 2 is a plan view showing a loader employed in the apparatus of FIG. 1.

As is shown in FIG. 2, the loader 16 performs the following. 50 semiconductor wafers 22 placed on two carriers 48 (i.e., 25 wafers on each carry) are subjected to orientation flat aligning performed by means of an orientation flat aligning mechanism 49, and then are pushed up by pushing bars 51. The bars 51 are gathered to each other, where the 50 wafers are received by the rotary transfer arm 24 located on the wafer carry-in side. The unloader 18 has a structure similar to the loader 16, but operates in the order inverse to that in which the loader 16 operates.

Figure 3:
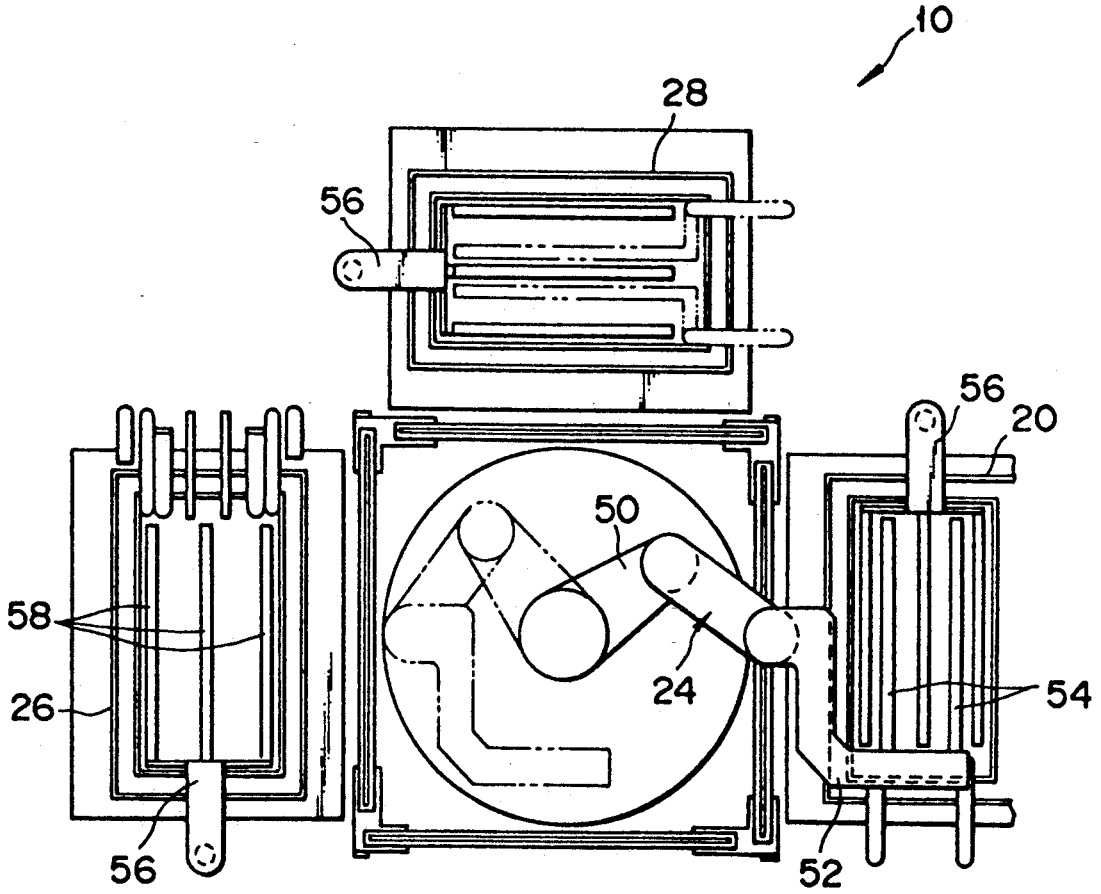
FIG. 3 is an expanded view showing a processing unit on the wafer carry-in side of FIG. 1.

As is shown in FIG. 3, the rotary transfer arm 24 has an arm body 50 having a plurality of joints and being able to expand, contract, and rotate in the horizontal direction. The tip portion of the body 50 is provided with a wafer fork 52 for placing the 50 wafers 22 thereon without the carrier 48. The wafers are transferred from the fork 52 to the loader 16, vessels 26, 28, 30, 32, or 34, underwater loader 20, drying vessel 36, or unloader 18.

Specifically, the fork 52 is provided with two parallel support bars 54 having a plurality of support grooves for positioning the wafers 22, and being movable in the horizontal direction. Between the fork 52 and loader 16 (or unloader 18), the fork 52 receives the wafers 22 from the pushing bars 51 moving up and down between the two support bars 54, and transfers the wafers to the pushing bars 51.

Between the fork 52 and underwater loaders 20, washing vessels 26, 28, 30, 32, or 34, or drying vessel 36, the fork 52 receives the wafers 22 from a boat 56 provided for each of the vessels and being movable up and down, and transfers them to the boat 56.

Each boat 56 has three parallel support bars 58 having a plurality of support grooves for positioning the wafers 22, and can be moved up and down by an actuator 60. The three support bars 58 is arranged so as not to collide with the two support bars 54 of the wafer fork 52 in the up and down directions, and so as to extend along the outline of the wafer 22. The boat 56 does not use the carrier 48 to position the wafers 22. The wafers 22 are placed on the wafer fork 52 of the arm 24, and then the fork 52 is inserted into the vessel through the opening 38. At this time, the actuator 60 is expanded and pushes up the boat 56, whereby the wafers 22 are moved from the fork 52 to the boat 56. On the other hand, where the wafers 22 are placed on the boat 56, the boat 56 is moved up, and then the wafer fork 52 is inserted under the boat 56. The boat 56 is then moved down, thereby moving the wafers 22 to the fork 52.

The actuator 60 supporting the boat 56 may cause dust during its up/down movement, and also may corrode due to a chemical since it is provided in a vessel using the chemical. To avoid these inconveniences, a sealing mechanism is provided for preventing the dust from leaking from the actuator 60 into the vessel and also for preventing the chemical from leaking from the vessel into the actuator 60.

Figure 5:
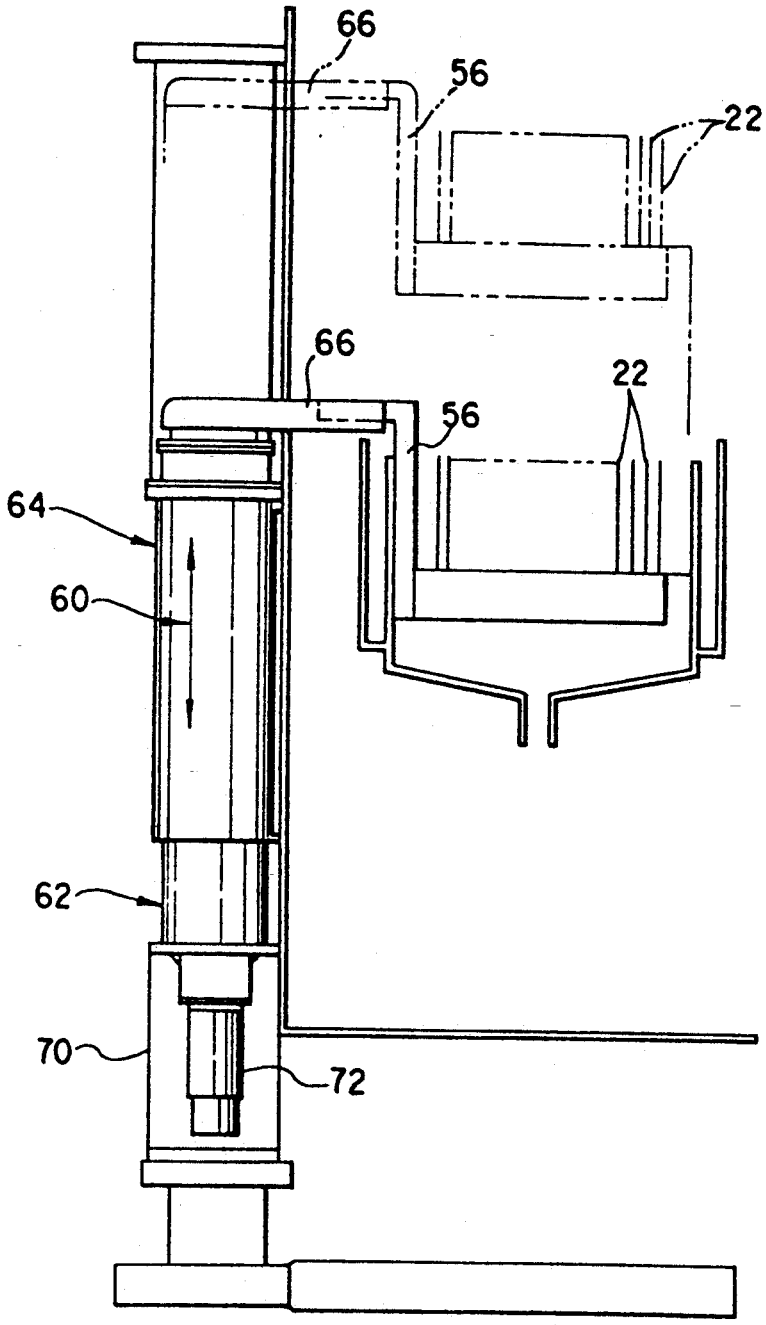
FIG. 5 is a side view showing an actuator and a boat.

Specifically, as is shown in FIG. 5, the actuator 60 comprises a stationers portion 62 and a movable portion 64. An arm 66, which is provided at the tip of the movable portion 64, and supports the boat 56 carrying the wafers 22, is moved up and down by moving up and down the movable portion 64.

Figure 6:
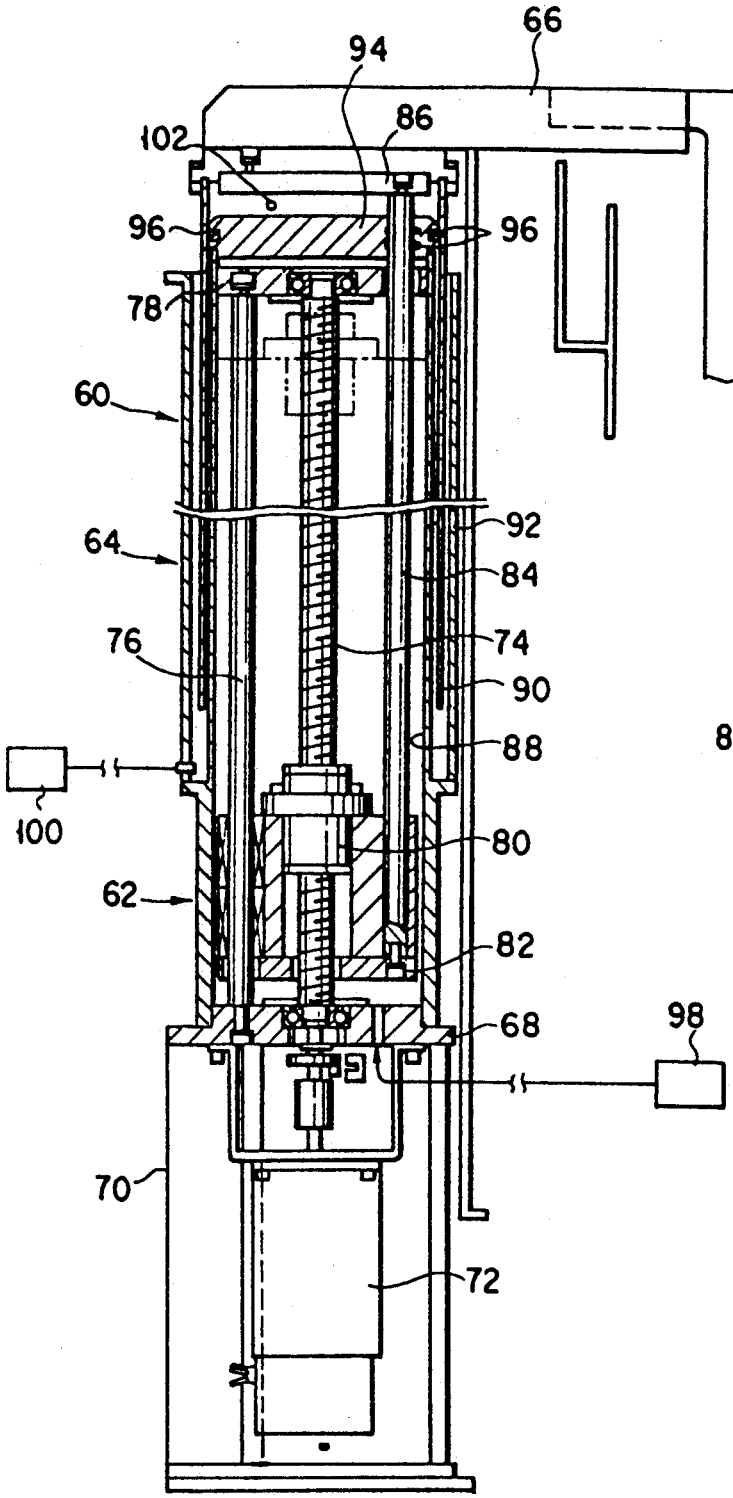
FIG. 6 is sectional view showing a sealing mechanism of the actuator shown in FIG. 5.

The sealing mechanism will be explained in detail with reference to FIG. 6.

In the stationary portion 62, a motor 72 is housed in an airtight manner in a housing 70 having a support base 68. A screw shaft 74 extends through the base 68, and is connected to the motor 72. Three guide shafts 76 are secured to the base 68 around the screw shaft 74 at regular intervals, and extending in parallel therewith. The other end of each of the guide shafts 76 and that of the screw shaft 74 are secured to a securing plate 78.

The movable portion 64 comprises a nut 80 screwed in the screw shaft 74, a first movable plate 82 integral with the nut 80 and loosely fitted on the screw shaft 74 and the guide shaft 76, three sliding shafts 84 extending in parallel with each other at regular intervals, and each having an end secured to the first movable plate 82 and the other end extending through the securing plate 78, and a second movable plate 86 supporting those ends of the sliding shafts 84 which extend through the securing plate 78. The movable portion 64 can move up and down along the screw shaft 74 and guide shaft 76. The arm 66 is provided above the second movable plate 86.

A cylindrical inner cover 88 is provided on the support base 68 of the stationary portion 62, and covers the screw shaft 74, guide shaft 76, sliding shafts 84, etc.

Further, a cylindrical intermediate cover 90 is provided on the side of the second movable plate 86 of the movable portion 64, and covers the inner cover 88. An outer cover 92 is secured to the inner cover 88, and covers the intermediate cover 90. The inner cover 88, intermediate cover 90, and outer cover 92 form a triple-layered cover having a space between each two adjacent layers. The covers 88, 90, and 92 are made of a corrosion resistant material, such as polyvinyl chloride. The upper end of the inner cover 88 is sealed by a sealing plate 94 provided above the stationary plate 78. Sealing members 96 are provided between the sealing plate 94 and sliding shafts 84 and between the sealing plate 94 and intermediate cover 90, respectively, and seal the clearances therebetween.

A pressurizing unit 98 is connected to the interior of the inner cover 88, for pressurizing atmosphere therein to a positive value. That is, the unit 98 prevents a gas such as ammonia from flowing into the inner cover 88 and thereby corroding the interior thereof. In the embodiment, a pressurized inactive gas such as nitrogen ($N_2$) is supplied to the interior of the cover 88 through a hole formed in the support base 68. Accordingly, ammonia, etc., cannot flow into the interior of the cover 88.

An exhaustion unit 100 is connected to a lower portion of a space defined between the inner and outer covers 88 and 92, for performing exhaustion between the intermediate and inner covers 90 and 88 and between the intermediate and outer covers 90 and 92. By virtue of the exhaustion, a gas such as ammonia and/or dust is prevented from flowing into a space between the inner and intermediate covers 88 and 90, if the gas or dust flows into the space between the intermediate and outer covers 90 and 92. Further, even if it flows into the space between the intermediate and inner covers 90 and 88, it will be exhausted by the exhaustion unit 100 since the space is kept under vacuum. The exhaustion unit 100 enables the driving device to use covers made of a slightly gas-permeable material as the covers 88, 90, and 92.

As described above, in the invention, pressure in the inner cover 88 is kept at a positive value by means of the pressurizing unit 98, and pressure in the space between the inner and intermediate covers 88 and 90 is kept at a negative value by exhausting gas therein by use of the exhaustion unit 100. Therefore, the gas existing inside the cover 88 always flows out of the same by the effect of the pressure difference. For example, dust caused in the cover 88 flows into the space between the inner and intermediate covers 88 and 90, and is forcibly exhausted therefrom. On the other hand, air outside the cover 92 flows into the space between the intermediate and outer covers 90 and 92, but is prevented from flowing into the cover 88.

To iterate the above, if atmosphere leaks from the inner cover 88 to the intermediate cover side, the atmosphere and dust contained therein will not leak to the outside of the intermediate cover 90, since they are sucked by the exhaustion unit 100. In this case, air which flows from the outside into the space between the covers 88 and 90 is sucked by the unit 100, together with the gas leaking from the cover 88.

Moreover, in the embodiment, a sensor (not shown) is provided for sensing the state of a chemical atmosphere, and the pressurizing unit 98 and exhaustion unit 100 are controlled based on a sensed value so as to keep the atmosphere to have an optimal pressure.

Further, an air inlet 102 for allowing a small amount of air to be guided into and out of the interior of the movable portion 64 is provided between the sealing plate 94 and second movable plate 86, so as to prevent the interior of the driving device from being completely sealed. This complete sealing may cause pumping effect during the operation of the actuator 60, thereby guiding ammonia gas or other into the driving device.

Figure 7:
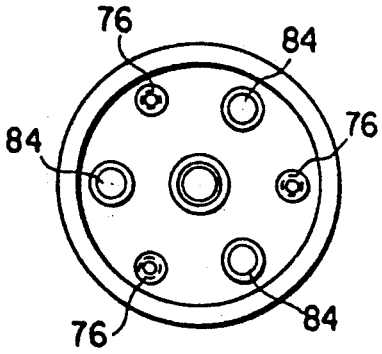
FIG. 7 is a plan view showing shafts employed in the actuator.
Figure 8:
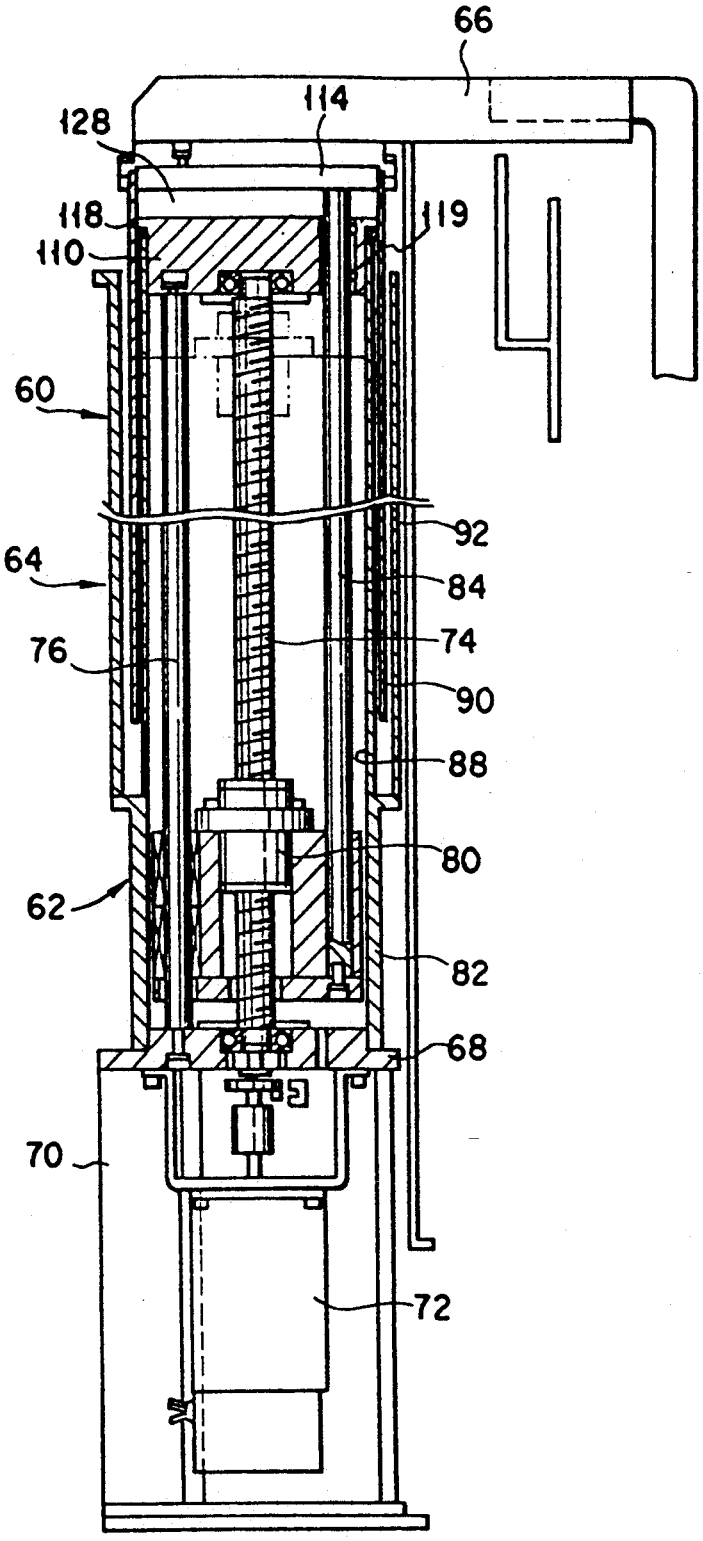
FIG. 8 is a cross sectional view taken along VIII—VIII in FIG. 10, showing an aspect of the inner structure of an actuator according to another embodiment.
Figure 9:
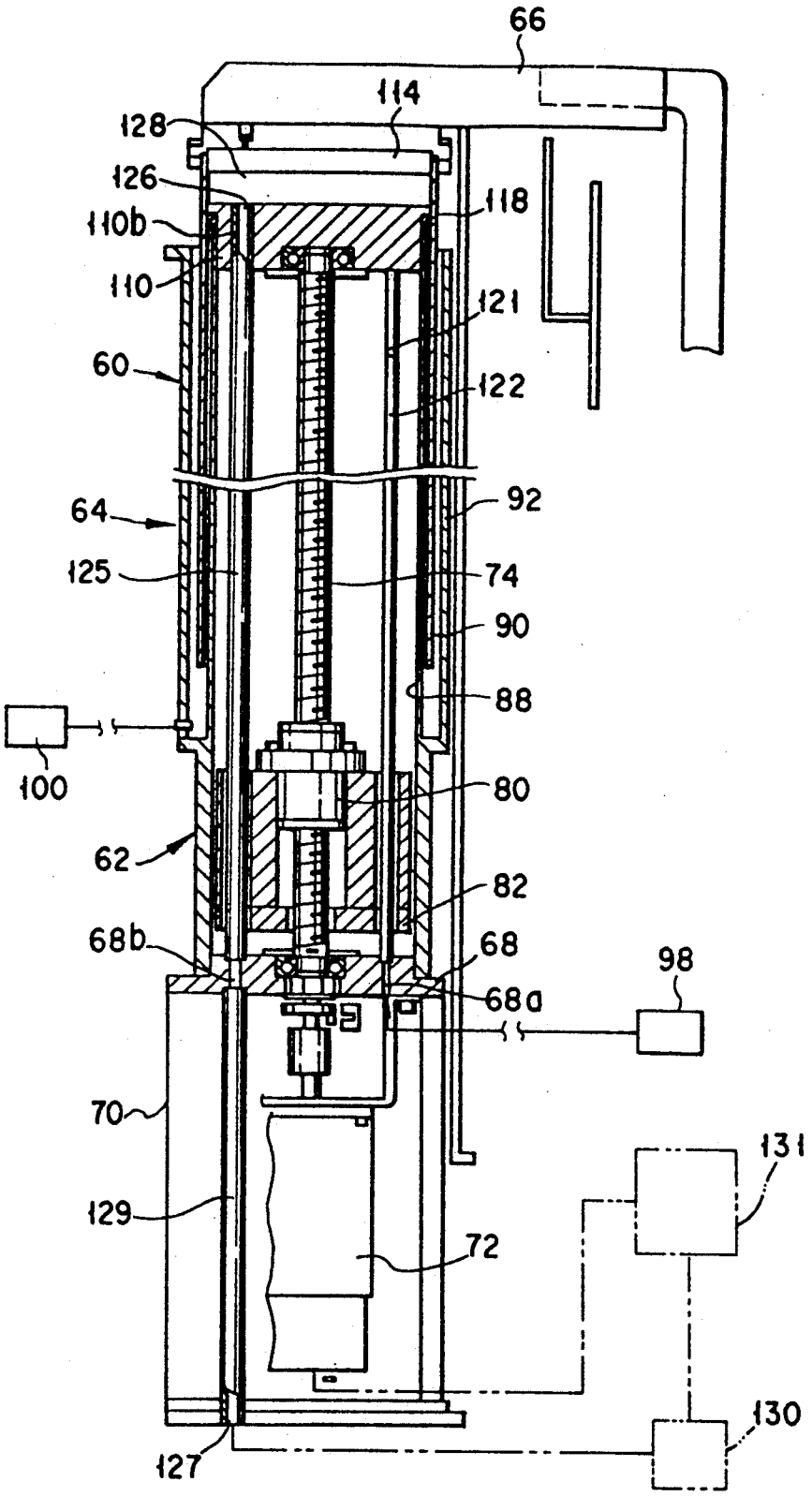
FIG. 9 is a cross sectional view taken along IX—IX in FIG. 10, showing another aspect of the inner structure of the actuator of FIG. 8.
Figure 10:
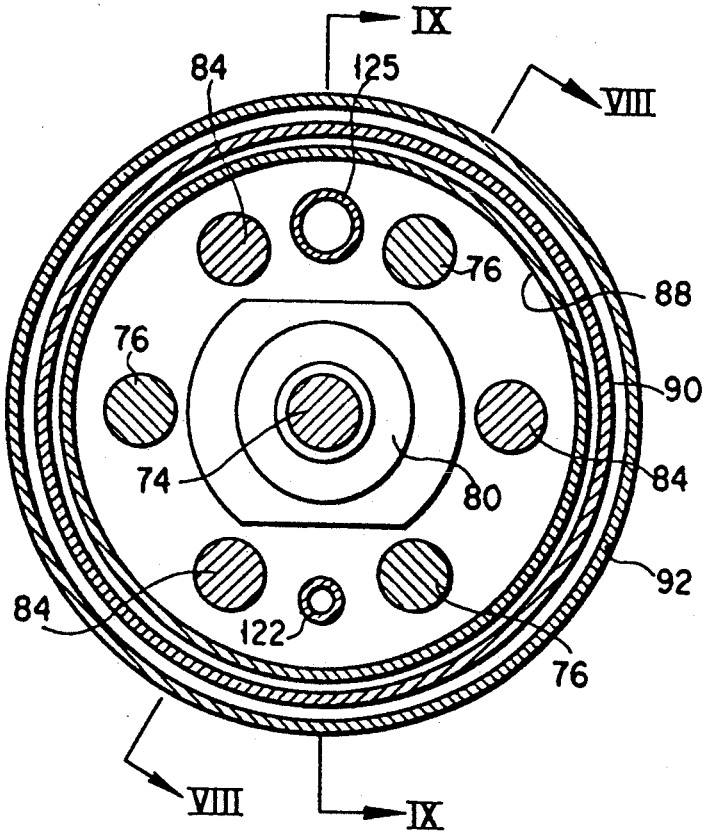
FIG. 10 is a transverse sectional view, showing the arrangement of shafts and pipes of the actuator of FIG. 8.

FIG. 8 is a cross sectional view taken along VIII—VIII in FIG. 10, showing an aspect of the inner structure of an actuator to another embodiment. FIG. 9 is a cross sectional view taken along IX—IX in FIG. 10, showing another aspect of the inner structure of the actuator of FIG. 8. FIG. 10 is a transverse sectional view, showing the arrangement of shafts and pipes of the actuator of FIG. 8. In these figures, elements corresponding to those in FIGS. 6 and 7 are denoted by reference numerals corresponding thereto, and explanation of the elements is omitted.

In this embodiment, a stationary plate 110 connected to the upper ends of the screw shaft 74 and guide shaft 76 is provided in place of the stationary plate 78 and sealing plate 94, and has the functions of them. A seal packing 118 seals between the inner cover 88 and stationary plate 110, while a seal member 119 seals between the slide shaft 84 and stationary plate 110.

A second movable plate 114 provided in the upper end of the intermediate cover 90 covers the upper end in the form of a blind patch. Thus, a sealed space 128 is defined between the end of the inner cover 88, i.e., the stationary plate 110, and the upper end of the intermediate cover 90, i.e., the second movable plate 114.

The pressurizing unit 98 for pressurizing the interior of the inner cover 88 and keeping it under positive pressure is connected to a pressuring gas supply pipe 122 through the hole 68*a* of the support base 68. The pipe 122 is secured to the support base 68 such that the lower end of the pipe is aligned with the hole 68*a*, and the upper end is secured to the stationary plate 110 in a blind manner. A gas supply hole 121 is formed in an upper portion of the pipe 122.

The pressurizing unit 98 is provided with a gas supply bomb for supplying an inactive gas such as $N_2$ gas, and jets $N_2$ gas into the inner cover 88 through the pipe 122 and hole 121. This keeps the interior of the cover 88 under positive pressure, thereby preventing atmospheric air from flowing into the cover 88 and corroding the driving unit. Further, $N_2$ gas supplied from the upper side can make dust (caused by the screw shaft 74, guide shaft 76, slide shaft 84) flow toward the support base 68. Thus, dust can be prevented from flowing into the space between the inner cover 88 and intermediate cover 90.

An exhaustion unit 100 having a structure similar to that of a corresponding element in the aforementioned embodiment is connected to a lower portion of the space defined by the inner cover 88 and outer cover 92, so as to exhaust gas existing between the inner cover 88 and intermediate cover 90 and between the intermediate cover 90 and outer cover 92.

By performing such exhaustion, even if a gas such as ammonia gas and/or dust flow from the upper end of the outer cover 92, they can be prevented from flowing into the space between the inner cover 88 and intermediate cover 90. In addition, even if atmospheric air flows into the space between inner cover 88 and intermediate cover 90, it can be exhausted by the exhaustion unit 100 since the space is kept under a negative pressure. Furthermore, if gas within the inner cover 88 leaks into the space between the intermediate cover 90 and outer cover 92, it is prevented from leaking to the outside of the outer cover 92, since gas in the space between the covers 90 and 92 is exhausted by the exhaustion unit 100.

A gas (air) supply/exhaustion pipe 125 is provided in the axial direction of the inner cover 88 so as to connect the hole **68*b* of the support base 68 to the hole 110*b* of the stationary plate 110. The pipe 125 has an upper opening 126 which opens to a sealed space 128 defined between the stationary plate 110 and movable plate 114. The lower end of the pipe 125 is connected via the hole 68*b* to a connection pipe 129 provided through the housing 70. The piper 129 has a lower end 127** communicating with the atmosphere.

By virtue of the above structure, satisfactory gas (air) supply and exhaustion can be performed in the sealed space 128 by vertically moving the intermediate cover 90 relative to the inner cover 88, and hence load can be reduced. Accordingly, vertical movement of the actuator can be performed smoothly at high speed.

As is indicated by an imaginary line or two-dot-chain line in FIG. 9, it is desirable to connect a gas (air) supply/exhaustion unit 130 to the pipe 125 and to perform gang control of the unit 130 and motor 72 by control means 131. In this case, supply/exhaustion can be performed more positively, thereby enabling more smooth and speedy vertical movement of the actuator.

Though in the above embodiment, there are provided one pressurizing gas supply pipe 122 and one supply exhaustion pipe 125, the invention may be modified such that a plurality of pressurizing gas supply pipes and supply/exhaustion pipes are provided. Further, the pipes 122 and 125 may be formed coaxially, i.e., they may be modified as an element having a double-pipe structure, thus more effectively using the space.

Though in the embodiments, 50 wafers 22 placed on the two carriers 48 are processed at a time, 25 wafers 22 placed on one of the carriers 48 may be processed at a time.

Further, though in the embodiments, the three processing units 10, 12, and 14 are used, the number of units to be combined may be changed.

Moreover, though the sealing mechanism of the invention is applied to the actuator 60 for moving the boats provided for the vessels, it may be applied also to other driving devices each having a driving portion comprising a rotary transfer arm or the like.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A driving device having a sealing mechanism, comprising:

a first cover defining a first space therein;

a second cover having an open end, and telescopically engaging with the first cover through the open end, for defining a second space therebetween;

driving means for moving the second cover in relation to the first cover in the axial direction thereof, part of the driving means at least being arranged in the first space;

a third cover arranged to surround the first and second covers over a range in which the open end of the second cover moves, the third cover defining a third space between itself and the first second and second covers;

gas supply means for maintaining pressure in the first space at a positive value;

pressure controlling means for supplying and exhausting a gas into and from the second space in accordance with a change in the volume thereof caused by movement of the second cover in relation to the first cover, thereby maintaining pressure in the second space at a substantially constant value; and exhaustion means for maintaining pressure in the third space at a negative value.

2. The driving device according to claim 1, wherein the device further comprises sealing means substantially insulating the first and second spaces from each other.

3. The driving device according to claim 1, wherein the third cover is formed integral with the first cover, and has an open end facing the peripheral wall of the second cover, and the other closed end.

4. The driving device according to claim 2, wherein the sealing means is secured to the first cover.

5. The driving device according to claim 1, wherein the driving means has a shaft extending through the first cover in the axial direction thereof and connecting the driving means to the second cover, and second sealing means is provided at that portion of the first cover through which the shaft extends.

6. The driving device according to claim 3, wherein the exhaustion means exhausts gas from the third space through that portion of the third cover which is located in the vicinity of the closed end thereof.

7. The driving device according to claim 1, wherein the gas supply means is inactive gas supply means.

8. The driving device according to claim 1, wherein the pressure controlling means is means for guiding air into and out of the second space.

9. The driving device according to claim 1, wherein the gas supply means supplies a gas from an upper portion of the first space.

10. The driving device according to claim 1, wherein the gas supply means has a pipe extending through the first cover in an axial direction thereof, the pipe having an opening formed in an upper portion thereof.

11. The driving device according to claim 1, wherein the pressure controlling means has a gas supply/exhaustion unit, and the driving means and the supply/exhaustion unit are controlled in an interlocking manner by control means.

12. The driving device according to claim 11, wherein the pressure controlling means has a pipe opening to the second space and extending through the first cover in an axial direction thereof.

13. A driving device having a sealing mechanism, comprising:

a first cover defining a first space therein;

a second cover having an open end, and arranged coaxial with the first cover and surrounding the same, for defining a second space therebetween;

driving means for moving the second cover in relation to the first cover, part of the driving means at least being arranged in the first space;

a third cover arranged to surround the first and second covers over a range in which the open end of the second cover moves, the third cover defining a third space between itself and the first and second covers;

gas supply means for maintaining pressure in the first space at a positive value; and exhaustion means for maintaining pressure in the third space at a negative value wherein the device further comprises sealing means substantially insulating the first and second spaces from each other.

14. The driving device according to claim 13, wherein the third cover is formed integral with the first cover, and has an open end facing the peripheral wall of the second cover, and the other closed end.

15. The driving device according to claim 13, wherein the gas supply means is inactive gas supply means.

16. The driving device according to claim 14, wherein the exhaustion means exhausts gas from the third space through that portion of the third cover which is located in the vicinity of the closed end thereof.

* * * * *